United States Patent [19]

Zucker

[11] Patent Number: 4,557,466

[45] Date of Patent: Dec. 10, 1985

[54] INERTIAL BARRIER

[75] Inventor: Stanley Zucker, Suffern, N.Y.

[73] Assignee: Energy Absorption Systems, Inc., Chicago, Ill.

[21] Appl. No.: 583,812

[22] Filed: Feb. 27, 1984

[51] Int. Cl.[4] ..... E01F 15/00

[52] U.S. Cl. ..... 256/13.1; 404/6

[58] Field of Search ..... 256/13.1, 1; 267/116, 267/139; 404/6

[56] References Cited

U.S. PATENT DOCUMENTS

| | | | |
|---|---|---|---|
| Re. 29,544 | 2/1978 | Fitch . | |
| 3,288,440 | 11/1966 | Schimmelpennick et al. . | |
| 3,786,956 | 1/1974 | Tabor . | |
| 3,856,268 | 12/1974 | Fitch . | |
| 3,880,404 | 4/1975 | Fitch . | |
| 3,916,816 | 11/1975 | Fitch . | |
| 4,073,482 | 2/1978 | Seegmiller et al. . | |
| 4,183,504 | 1/1980 | Ford | 256/13.1 |
| 4,289,419 | 9/1981 | Young et al. | 256/13.1 X |

OTHER PUBLICATIONS

"Energite"—A New Inertial Barrier System.

"Use of Crash Cushions on Federal-Aid Highways," App. V, p. 5; pp. 29, 30; 1972.

FIBCO "How They Work", p. 5.

*Primary Examiner*—Andrew V. Kundrat

*Attorney, Agent, or Firm*—Willian Brinks Olds Hofer Gilson & Lione Ltd.

[57] ABSTRACT

An inertial barrier system can be constructed with barrier units of various, sequentially increasing barrier weights (i.e., masses). The inertial barrier units are each constructed from similar parts, namely, a frangible hollow container of conical or other generally circular cross section having upper and lower portions, with the lower portion being joined to the upper portion by a substantially annular horizontal ledge; an inner core of frangible material and formed substantially as a hollow conic member with an annular flange at the open base of the conic member, the flange being dimensioned to fit onto and be supported by the ledge of the container; and a frangible cover to fit the open top of the container. The inner core is orientable in either an upwards position or a downwards position, each of which has the flange of the core resting on the ledge of the container. A unique feature of the inner core is that only a single core is needed for the various options of granular material; by contrast, conventional systems require separate cores for each of generally five options, namely, 200, 400, 700, 1400 and 2100 pounds of granular material. The container is divided thereby into a lower section and upper section, with the upper section receiving a fill of energy-absorbing granular material, such as sand. Indicia embossed on the core and on the inside of the container indicate the various predetermined levels to which the container is to be filled to provide a barrier unit of the proper predetermined weight.

13 Claims, 14 Drawing Figures

INERTIAL BARRIER

This invention relates to highway safety devices, and is more particularly directed to inertial barriers of the type used to decelerate an errant vehicle colliding therewith to reduce the potential for the vehicle from striking a roadway hazard, such as a bridge abutment or the like.

It is now common to provide a so-called inertial barrier formed of an array of containers, each at least partially filled with sand or with some other readily dispersable particulate material, as an energy attenuating medium.

These barriers have proven useful in limiting the effects of single-vehicle accidents, which constitute fully a third of the fatal accidents in this country. In the usual case, a driver loses control of his or her vehicle, which then leaves the main roadway and often strikes a fixed obstruction adjacent to the roadway. Often these obstructions are part of the roadway systems themselves, such as bridge abutments, sign posts, or concrete dividers. An errant vehicle can also present a danger to highway repair crews, and the inertial barriers can favorably be employed at the site of a highway repair or construction operation.

It is clear that the occupants of the vehicle can be protected only by controlling the rate of vehicle deceleration to a reasonable figure, for example, to within the range of about 6 to 12 g's, that is, six to twelve times the normal force of gravity. This, of course, then will then reduce the severity of injury to the occupants of the vehicle from a so-called "second collision" which would otherwise occur when the occupants struck the interior of the vehicle.

It need only be mentioned briefly that damage to the roadway structures themselves by such an errant vehicle should also be limited, as most highway structures are rather expensive to replace, and their repair can involve danger to workmen as well as delays to motorists.

As the impact velocity of the errant vehicle is substantially the same as the speed that the vehicle was driven on the road, and its ultimate speed after collision must be zero, the effects of the collision can be reduced only by increasing the distance through which the vehicle and its occupants are decelerated.

One practical means for carrying this out involves an array of energy-absorbing units filled with a dispersible particulate medium, such as sand. Typically, these barrier units are constituted by sand-filled frangible plastic drums, with the amount of sand varying from one barrier unit to the next in a predetermined fashion so that an errant vehicle crashing into the barrier system is decelerated with the minimum damage to the vehicle and its occupants.

Typically, spacers or lightweight supports are provided at the base of the barrel so that the center of gravity of the barrier unit is about the same as that of the errant vehicle, typically about two feet above the ground. This prevents the errant vehicle from either "ramping" or climbing over the units on collision or from nosing under the units.

Because the plastic containers for these units are shatterable if struck at highway speeds, e.g., 55 miles per hour, the effect of the barrier on stopping the errant vehicle comes about by transfer of momentum of the vehicle to the sand or other dispersable particulate medium. By arranging the barrier units, in order of striking, from lighter to heavier in terms of amount of sand contained therein, the errant vehicle can be caused to decelerate gradually and with a minimum damage to the vehicle and minimum risk to its occupants.

With the inertial barrier system, the errant vehicle engages only a predetermined one of these barrier units at a time, and instantly accelerates the unit, or the sand contained therein, to the vehicle speed. Thus, the errant vehicle shares the total vehicle momentum with the sand, thereby causing the vehicle to slow down in a controlled manner.

Two different phenomena are involved when a vehicle is stopped by the inertial barrier system. Initially, deceleration of the vehicle occurs because of transfer of momentum from the vehicle to the barrier. This is referred to as the "inertial" phase during which the vehicle is slowed incrementally by hitting the sand-filled containers one after the other. This phase continues until the vehicle velocity has dropped to between about 10 and 20 miles per hour.

At this point, the "bulldozing" phase begins, and the remaining vehicle kinetic energy is dissipated by friction with the sand as the vehicle "bulldozes" through the last rows of containers.

The barrier units are all of generally similar construction, favorably being about three feet across and about three to four feet in height. The particular fill of sand for each barrier unit varies, as does its placement within the container of the barrier unit, so that the barrier has a desired predetermined weight and the center of gravity of the barrier unit remains at approximately two feet elevation.

Typically, the barrier units of a given inertial barrier system have certain predetermined fill amounts, typically 200, 400, 700, 1400, and 2100 pounds. While these weights have been standardized, other intermediate weights, e.g., 900 pounds, could be used in addition or instead.

In keeping with one known system of inertial barriers, the barrier units include a cylindrical shatterable module, in which a lightweight core supports a disc upon which the fill of sand rests. These barrier modules are formed of flat sheets riveted together on site to form a cylindrical container; this step adds to the difficulty of installation of the inertial barrier. A lid covers the top of the module to keep the sand or other energy-dispersing medium dry. In order to vary the weight of the containers one from another, a variety of hollow lightweight cores are kept on hand, each corresponding to a different barrier weight, i.e., a different amount of sand.

In another inertial barrier system, outer containers all of the same size are used, and frangible inserts of generally wine glass configuration are employed, each of a different size, so that different fill weights of sand or other energy-attenuating medium can be used in the standard-sized outer containers. While this approach is generally satisfactory, it requires a different size wineglass insert for each predetermined fill weight of sand. That is, if it is desired to have barriers of 200, 400, 700, 1400, and 2100 pound weights, it is necessary to have five different sizes of inserts or containers, one for each predetermined fill weight. This means that all five of these must be stocked and kept on hand to permit sufficient flexibility in constructing highway barrier systems as needed.

It is an object of this invention to provide an inertial barrier system suitable for attenuating the kinetic energy of an errant vehicle to prevent the latter from striking a roadway hazard. The various barrier units of the inertial barrier system each consist of parts which can be used universally for the different given barrier weights that are required.

It is a more particular object of this invention to provide barrier units for an inertial barrier system in which a standard-sized outer container, a standard-sized inner core, and a standard-sized lid can be used to construct suitable barrier units of any of a plurality of different barrier weights.

In accordance with several preferred embodiments of this invention, the inertial barrier system includes barrier units each comprising a frangible hollow container of generally circular cross-section and having upper and lower portions, the lower portion being joined to the upper portion by a substantially annular horizontal ledge, with the upper portion having an open top. An inner core of frangible material, formed substantially as a hollow conic member open at a larger base thereof, has an annular flange at the open base of the conic member. The flange is dimensioned to fit onto and to be supported by the ledge of the container. The inner core is orientable into either an upwards position, in which the inner core, with the flange thereof resting on the ledge, extends up into the upper portion of the container; and a downwards position in the which inner core, with its flange resting on the ledge, extends down into the lower support portion of the container. The container is divided by the inner core into a lower section and an upper section, with the upper section receiving a fill of an energy-absorbing granular material, such as sand. Finally, a lid or cover overfits the top of the container to protect the sand or other energy-absorbing material from the elements.

The support section is favorably of sufficient height so that the inertial barrier, when filled with the desired predetermined amount of the sand or other granular material, has a center of gravity substantially equal to that of an average passenger car roadway vehicle, e.g., about two feet.

Also preferably, the outer containers are nestable one inside the other so that they can be stacked for storage; similarly, the conic inner cores can also be nested one inside the other to be stacked compactly for storing, shipping, or transporting.

In many favorable embodiments, the lower, support portion of the outer container is fluted, i.e., is provided with vertical flutings, to increase its support strength in the axial, or vertical direction. This fluting also promotes the shattering of the lower portion, when struck by an errant vehicle, by providing fracture lines thereon. The fluting also provides an aesthetic treatment.

The above and many other objects, features, and advantages of this invention will become more fully understood by considering the ensuing description of the detailed embodiment thereof in connection with the accompanying drawings, in which:

FIG. 1 is an exploded view of a barrier unit according to the present invention;

FIGS. 2A–2C schematically illustrate three different weight options of the barrier unit of this invention, with the core thereof oriented in an upwards position;

Figure 1:
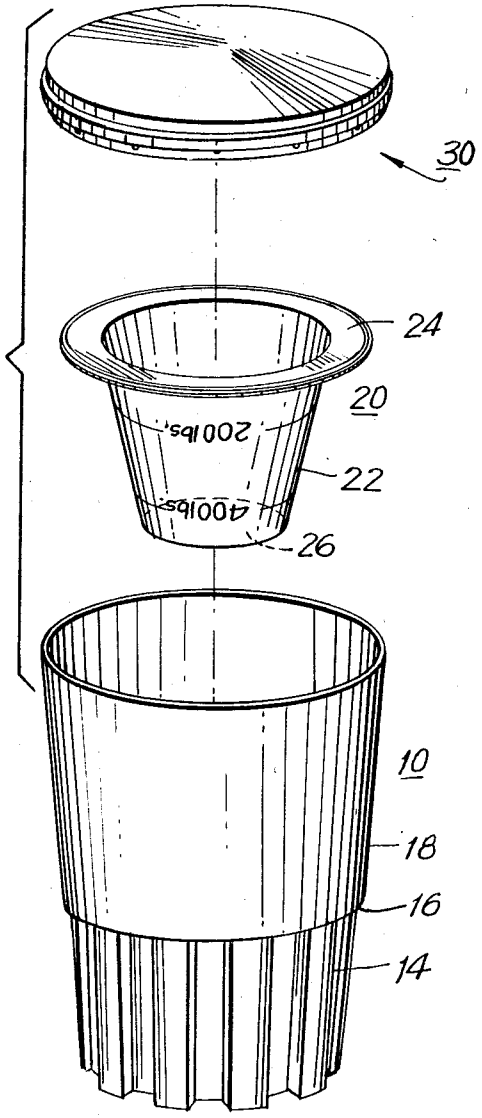

With reference to the drawings, and initially to FIG. 1 thereof, the barrier unit is shown to comprise three units, each formed of a shatterable plastic material, such as polyethylene: an outer container or shell 10, a high-hat inner core 20, and a cover or lid 30 which fits over the open top of the container 10.

Figure 4:
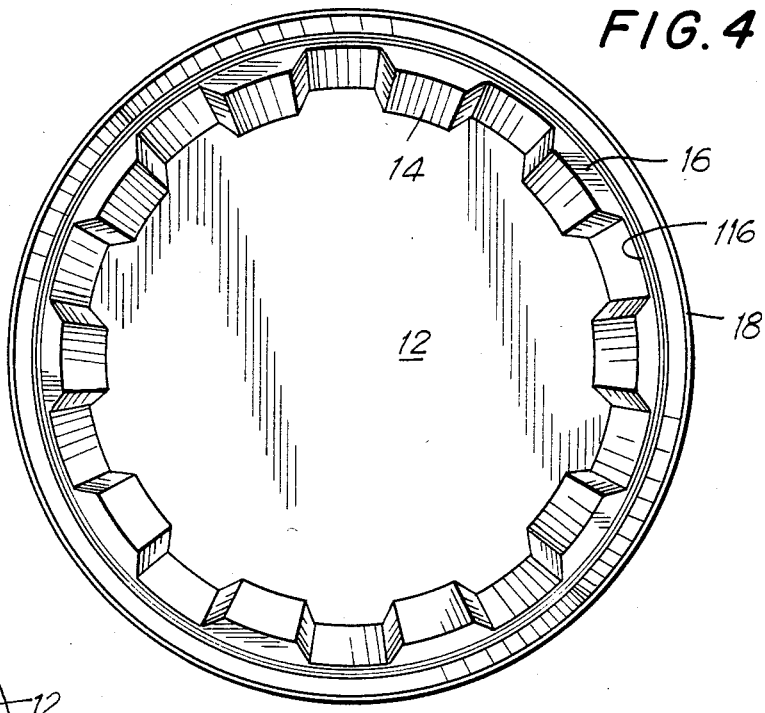
FIG. 4 is a plan view of the outer container.
Figure 5:
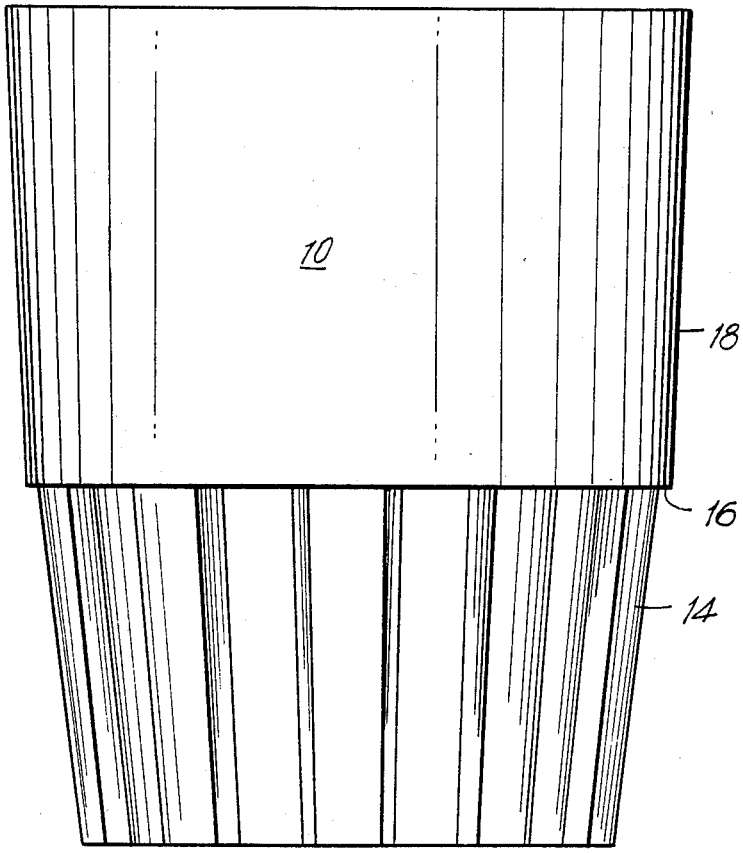
FIG. 5 is an elevational view of the outer container.

The container 10, as also shown for example in FIGS. 1, 4, and 5, has a base 12, a lower support section 14 including a fluted, generally conic wall, an annular support ledge 16 extending generally horizontally, and having an inner edge connected to the top of the support portion 14, of the ledge 16, and a conic upper portion 18, with the outer edge connected to a base of the upper portion 18. While not shown, the outer surface of the container 10 can have a distinctive chevron design thereon to promote visibility to oncoming motorists.

Figure 6:
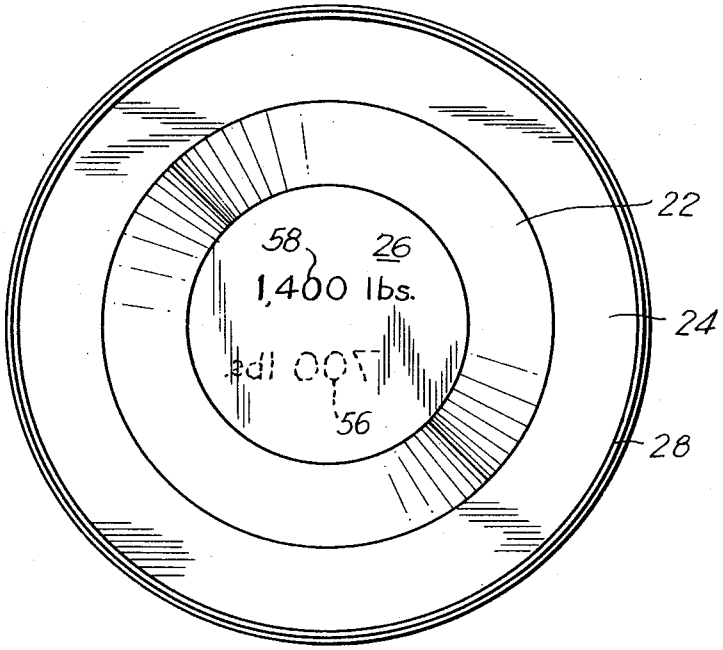
FIGS. 6 and 7 are plan and elevational views, respectively, of a "high hat" inner core of a preferred embodiment of the invention.
Figure 7:
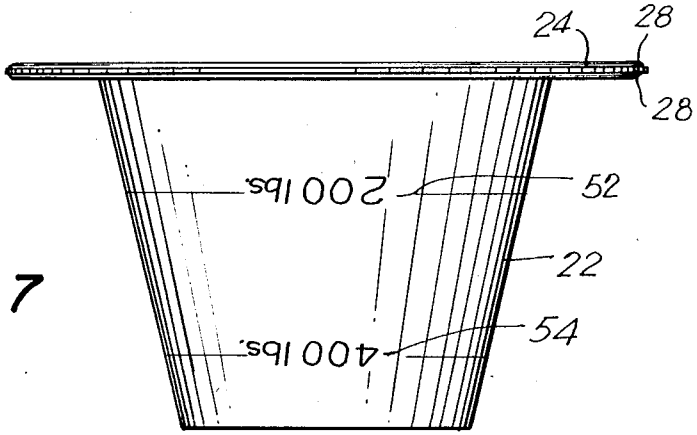

The inner core 20, as shown in FIG. 1 and as also shown in FIGS. 6 and 7, has a frustroconic hollow dish member 22, also formed of a shatterable material, such as polyethylene. An annular flange 24 encircles and extends radially outwards from an open, larger base of the member 22. A small disc 26 closes off the smaller upper base of the frustroconic member 22. Also shown on this core 20 is an annular bead 28 extending around the periphery of the flange 24. This bead 28 fits into an annular groove 116 (see FIG. 4) in the annular ledge 16 to help seal against seepage of sand which might otherwise occur, owing to road vibration.

Figure 8:
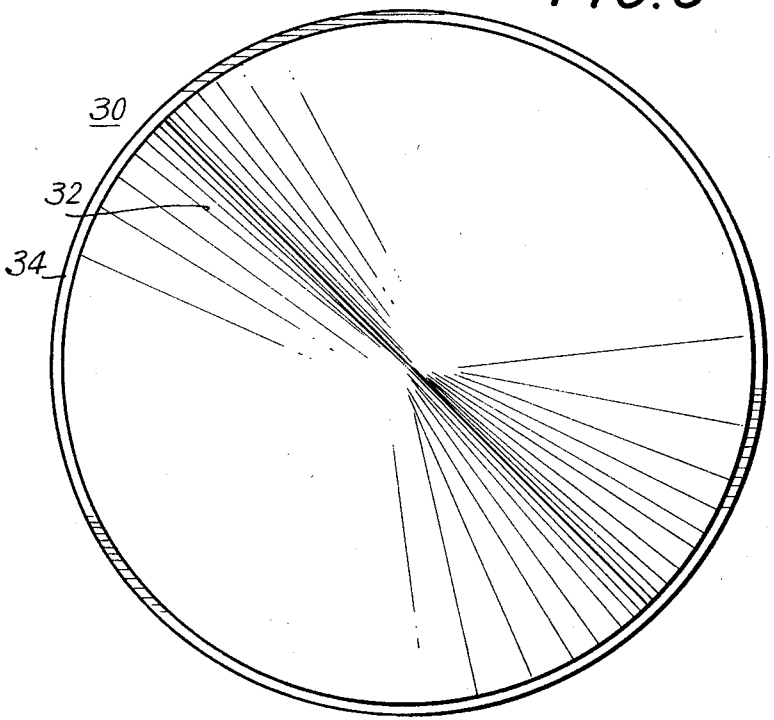
FIGS. 8 and 9 are plan and elevational views of the lid for the container of the described embodiments.
Figure 9:
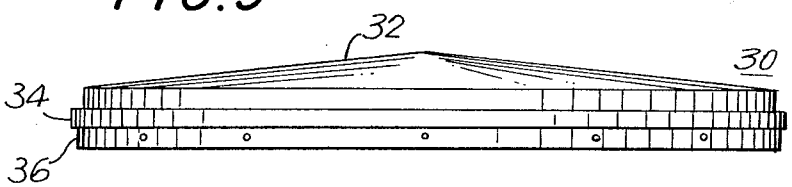

The cover or lid 30, also shown in FIGS. 8 and 9, has a domed top 32 shaped to shed water, a recess 34 of approximately one-inch height to secure the lid to a corresponding lip on the top of the container 10, and a flat side 36, also of approximately one-inch height, with apertures therein for optional pop-riveting to secure the lid 30 to the container 10. The lid 30 may be embossed, for example, with a distinctive design or with a product name, or alternatively may be coated with a safety high-visibility color design, with reflective material, or with other similar features.

Figure 4A:
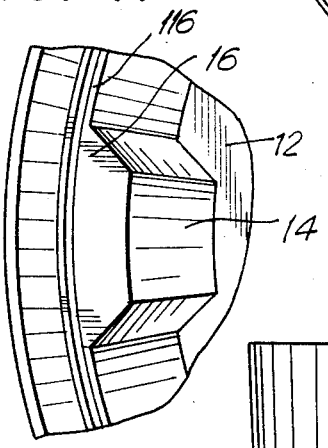
FIG. 4A is a detail sectional view showing the fluting of the lower support section of the outer container.

As is shown in FIGS. 4, 4A, and 5, the lower support portion 14 is favorably constructed with fluted sides. This fluting can have a generally crenelated cross section, as shown in FIG. 4A. The fluting adds additional vertical or axial support for supporting the upper portion and inner core when the barrier unit is filled with sand 40, and also provides possible lines of fracture, so that if the container 10 is struck by an errant vehicle, the radial force therefrom will tend to shatter the container 10 along the fluting lines, and promote the scattering of sand. This aids the deceleration of the errant vehicle during the "inertial" phase.

As shown in FIGS. 6 and 7, the frustroconic member 22 and the top disc 26 of the "high hat" inner core 20 each carry indicia thereon to indicate the level of sand 40, or of another energy-absorbing granular medium, corresponding to a particular predetermined barrier weight.

In particular, the core 20 has "200 pound" and "400 pound" indicia, 52 and 54, respectively, embossed on an outer conic surface of its member 22, while the disc 26 can have "700 pound" indicia embossed on an outer surface thereof (shown in ghost lines in FIG. 6) and "1400 pound" indicia 58 embossed on an inner surface thereof.

Figure 2C:
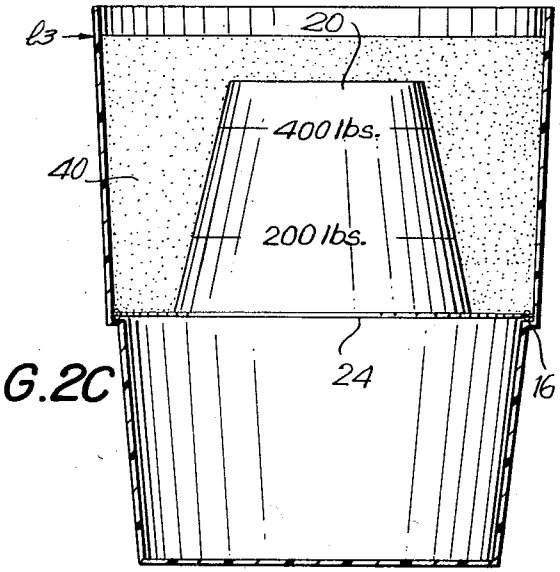
Figure 2B:
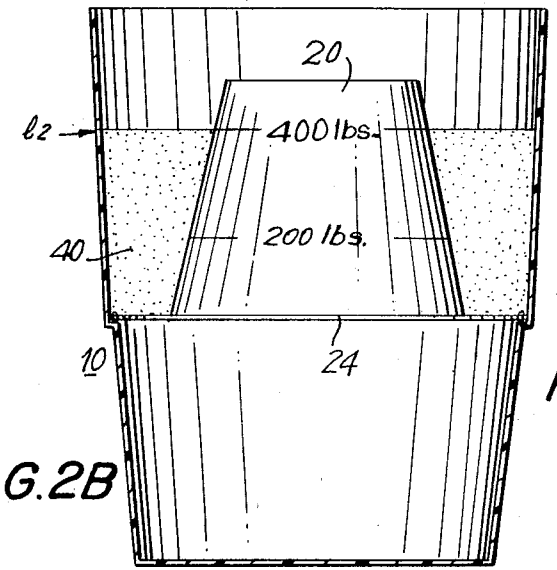
Figure 2A:
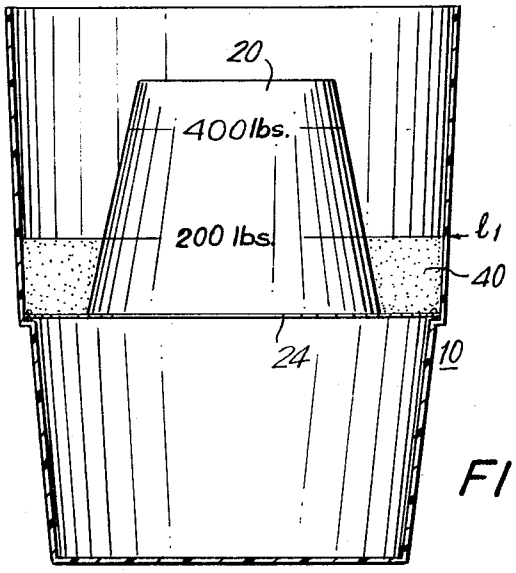

As shown in FIGS. 2A–2C, if the "high hat" inner core 20 is oriented in an upwards position within the container 10, with the flange 24 thereof resting on the ledge 16 of the container 10, sand 40 can be filled at various levels corresponding to several predetermined barrier weights. In particular, sand 40 can be filled to 200 pound level $l_1$ (FIG. 2A), a 400 pound level $l_2$ (FIG. 2B), or a 700 pound level $l_3$ (FIG. 2C).

Figure 3B:
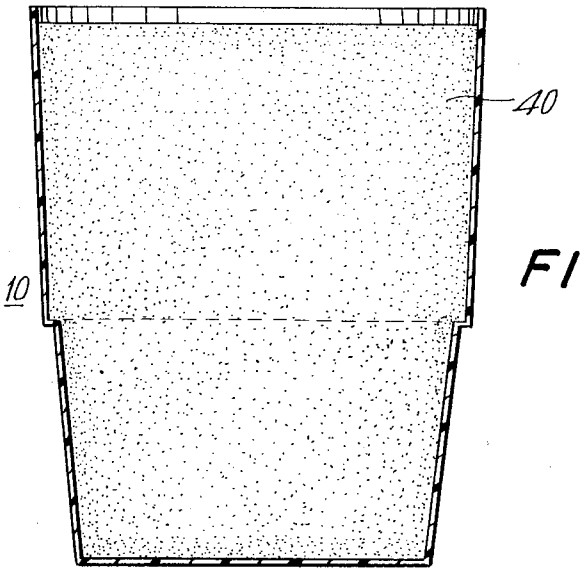
FIGS. 3A and 3B illustrate additional weight options of the barrier unit of this invention, with the core thereof oriented in a downwards position, and omitted, respectively.
Figure 3A:
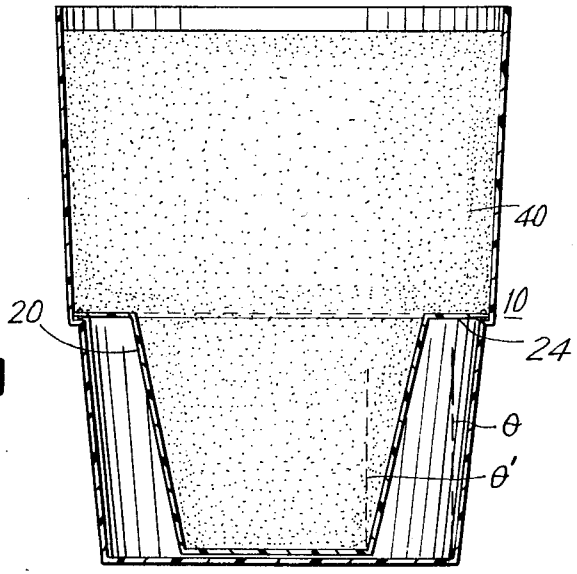

If the high-hat inner core 20 is oriented in a downwards position, as shown in FIG. 3A, the flange 24 thereof rests on the ledge 16, and, at the same time, the base disc 26 of the core 20 rests on the base 12 shown in FIG. 1 of the lower portion of the container 10. In this configuration, a fill of sand up to the level $l_4$ provides a barrier weight of 1400 pounds.

Finally, as shown in FIG. 3B, if the "high-hat" inner core is omitted, the entire container 10 is filled with sand 40 up to the level $l_4$, providing a barrier weight of 2100 pounds.

Here, in the frangible container, the wall of the lower support portion 14 slopes outwards at an angle (see FIG. 3A) with respect to the vertical (i.e., with respect to the container axis). The frustroconic member 22 has an apical angle $\theta'$, i.e., relative to its axis, that is greater than the angle $\theta$.

As shown in FIGS. 4 and 5, the container 10 of this embodiment is favorably dimensioned as indicated below so as to permit nesting of containers 10 one inside another. The containers so constructed can be stacked compactly together when stored or transported. Preferably, the container 10 has an overall height of 43½ inches, the upper portion 18 having a height of 25½ inches and the lower support portion 14 having a height of 18 inches. The upper portion 18 favorably tapers from about 31 inches at the ledge 16 to about 36 inches at the top, and the lower support portion 14 favorably tapers from 28 inches at the base 12 to about 30 inches at the ledge 16. The latter preferably has a width of substantially ½ to 1½ inches.

As is further illustrated in FIGS. 6 and 7, in the high-hat inner core 20 of the preferred embodiment here is described, the disc 26 has a diameter of 7 inches, and carries the indicia 56 and 58 on the outside and inside thereof, respectively. The frustroconic member frustrom 22 has a height of 18 inches, and a width of 28½ inches at its mouth. The flange 24, as shown in FIG. 6, has an inside diameter of 28½ inches and an outside diameter of 32¾ inches.

As shown in FIGS. 8 and 9, the lid or cover 30 has a diameter of 36 inches: the recess 34 has an outside diameter of 37¼ inches.

Returning to FIG. 5, the inner sides of the upper portion 18 of the container 10 can be embossed to indicate the fill levels $l_3$ and $l_4$ respectively indicating (a) the 700 pound level (with the inner core 20 oriented in its upwards position) and (b) the 1400 pound level (with the inner core 20 oriented in its downwards or fill position). The lever $l_4$ also corresponds to the 2100 pound level, where the inner core 20 is omitted altogether. Here, the level $l_4$ is substantially 5 inches above the level $l_3$. This maintains the center of gravity of the entire barrier at about a two foot level above the roadway surface, corresponding approximately to the center of gravity of a passenger car.

Figure 10:
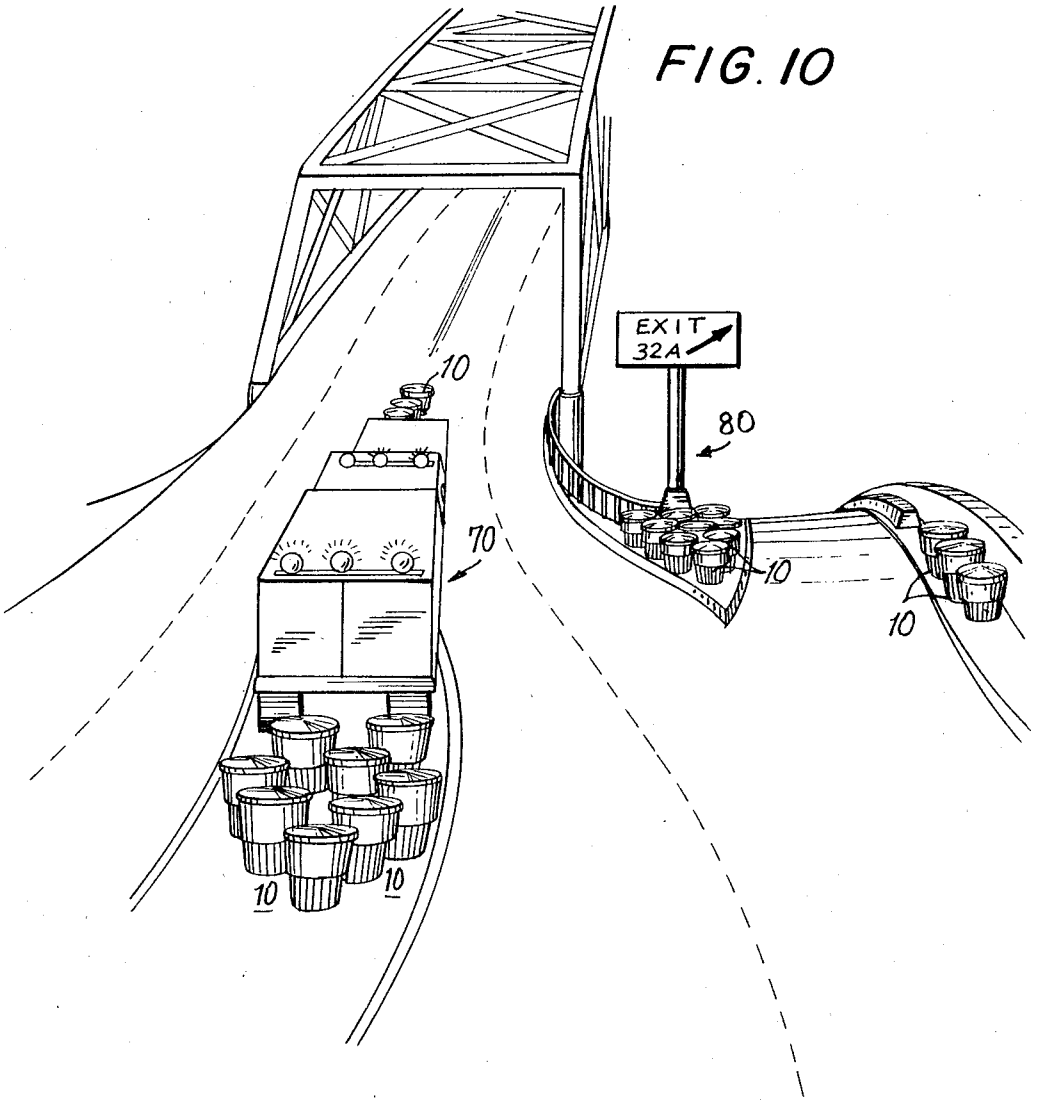
FIG. 10 is an environmental view illustrating the use of the barrier units of this invention in typical inertial barrier installations.

FIG. 10 illustrates typical barrier installations to protect against various hazards, first of all, to protect from collision against a highway repair truck 70 or other movable roadwork site, and also to protect from collision against a permanent structure 80, which can be bridge abutment, a ramp divider, signage, or other permanent hazard. For each barrier installation, the containers 10 are aligned, and are each fitted with inner cores 20 and with an appropriate amount of sand or other dispersable granular material. In a typical installation, the insulation includes a row of barrier units of progressively higher weight in the direction towards the hazard 70 or 80, e.g., 200 pounds, 400 pounds, 700 pounds, to provide the inertial phase of declaration for an errant vehicle colliding therewith. The installation can then include double rows of the barrier units, followed by treble rows, of progressively heavier weights, e.g., 700 pounds, 1400 pounds, 2100 pounds, as the barrier units are placed closer to the hazard 70 or 80. The last rows provide the bulldozing phase of deceleration for the errant vehicle.

As mentioned previously, the first barrier units create an inertial zone, where the inertia of the errant automobile or other vehicle striking the barrier installation is dissipated by scattering of the sand 40. These barrier units in the inertial zone act to slow the vehicle down to a sub-inertial speed of between 10 and 20 miles per hours. Then, the remaining barriers constitute a bulldozing zone, where the impacting errant automobile or other vehicle plows into the barriers, and the stopping is basically due to friction with the sand and with the shattered plastic from the container 10 and core 20.

It should be apparent that when the barrier installation is comprised of barrier units according to this invention, a suitable crash cushion is provided for reducing the crash severity both to the errant vehicle and to its occupants if the vehicle would otherwise impact upon a roadway feature. This inertial barrier installation also provides a suitable crash cushion for the protection of roadway work crews and their equipment.

By providing a one piece inertial barrier outer container 10, the need to assemble sections prior to installation is eliminated. By providing a single inner core suitable for 200 pound, 400 pound, 700 pound, 1400 pound, and 2100 pound options, the need to order and stock several types of cores is avoided. Also, the use of a single size and type of inertial barrier inner core 20 simplifies and expedites field installations of the inertial barriers.

Moreover, the outer containers 10 being nestable with one another, provide containers for barriers of up to 2100 pound capacity, which can be stacked compactly to reduce the storage requirements. Moreover, the nesting frustroconic cores 20 can also be stacked compactly to reduce storage requirements.

The inertial barrier containers according to this invention also can serve as a crash cushion upon which other safety devices such as warning lights, flags, and signs, can be secured to alert approaching motorists of a hazard or of the presence of work crews and/or equipment in the roadway ahead.

With the roadway barrier units of any of various weights formed of the three standard-size members 10, 20, and 30, and of a supply of sand 40 or the like, the transportation of crash cushions or inertial barrier installations to and from changing sites can be facilitated.

These inertial barrier units can be favorably employed on a trailer-mounted transportable crash cushion of the type disclosed in U.S. patent application Ser. No. 452,151, filed by me and Fritz Schwarting on Dec. 22, 1982.

While the invention has been described in detail with reference to a single preferred embodiment, it should be understood that many modifications and variations thereof would be apparent to those of ordinary skill in the art without departure from the scope and spirit of the invention as defined in the appended claims.

I claim as my invention:

1. Inertial barrier for attenuating the kinetic energy of an errant vehicle to resist the latter's striking a roadway hazard, comprising a frangible hollow container of generally circular cross section and having upper and lower portions, the lower portion being joined to the upper portion by a substantially annular horizontal ledge intermediate said upper and lower portions, the upper portion having an open top;

an inner core of frangible material and formed substantially as a hollow conic member open at a larger base thereof, with an annular flange at the open base of the conic member, the flange being dimensioned to fit onto and be supported by the ledge of said container;

a sufficient fill of an energy-absorbing granular material; and a cover to fit the open top of the container with the inner core and the granular material in place in said container.

2. Inertial barrier according to claim 1, wherein said conic member is a conic frustrum having a height substantially equal to the height of the lower portion of said container such that when said inner core is disposed in a downwards position, the smaller base of the conic frustrum rests on a floor of the lower portion while said flange rests on said ledge; and the height of the upper portion is greater than the height of the conic frustrum, such that when said inner core is disposed in an upwards position, the smaller base of the conic frustrum is clear of the cover while the flange rests on the ledge.

3. Inertial barrier according to claim 1, wherein said flange and said ledge have a cooperating annular ridge and groove therein to form a seal such that said granular material disposed above the ledge of said inner core is inhibited from sifting through the juncture of said ledge and said flange.

4. Inertial barrier for attenuating the kinetic energy of an errant vehicle to prevent the latter from striking a roadway hazard, comprising a frangible hollow container of generally frustroconic shape, having a lower support portion with a conic wall sloping outward at an angle $\theta$, relative to an axis of the container, from a generally circular bottom to an inner edge of an annular horizontal ledge, and an upper portion having a conic wall sloping outward and rising from an outer edge of said ledge to a top of the container;

a high-hat inner core of frangible material having a generally frustroconic dish member and a generally annular flange extending outward from an open mouth of said dish member, the flange being dimensioned to fit onto and be supported by the ledge of said container, the inner core being orientable into either an upwards position in which the inner core with the flange thereof resting on said ledge extends up into the upper portion of the container, and a downwards position in which the inner core with its flange resting on said ledge extends down into the lower support portion of the container; the container being divided thereby into a lower section and an upper section, the upper section to receive a fill of an energy-absorbing granular material; and a cover fitting the top of the container.

5. Inertial barrier according to claim 4, wherein said support section is of sufficient height that said inertial barrier when filled with a desired predetermined amount of said granular material has a center of gravity substantially equal to that of an average roadway passenger car, to resist said errant vehicle, striking the barrier, from ramping over the same.

6. Inertial barrier for attenuating the kinetic energy of an errant vehicle to resist the latter's striking a roadway hazard, comprising a frangible container of generally circular cross section and having upper and lower portions, the lower portion being joined to an inner edge of a substantially horizontal annular ledge, intermediate said upper and lower portions, whose outer edge is joined to a base of said upper portion, said lower portion being fluted to augment the supporting strength thereof and to promote shattering of the lower portion when struck by an errant vehicle;

an inner core of frangible material and formed substantially as a hollow conic frustrum open at a larger base thereof, with an annular flange at the open base of the conic frustrum and extending outward therefrom, the flange being dimensioned to fit onto and be supported by the ledge of said container; the container being divided thereby into a lower section and an upper section, the upper section to receive a fill of an energy-absorbing granular material; and a cover fitting the top of the upper portion of said container.

7. Inertial barrier for attenuating the kinetic energy of an errant vehicle and to resist the latter's striking a roadway hazard, comprising a frangible hollow container of generally circular cross section and having an upper portion and a lower support portion, the lower portion being joined at its top to an inner edge of a substantially horizontal annular ledge whose outer edge is joined to a base of said upper portion;

an inner core of frangible material and formed substantially as a hollow conic member open at a larger base thereof, with an annular flange at the open base of the conic member and extending outward therefrom, the flange being dimensioned to fit into and be supported by the ledge of said container, the inner core being orientable into either of an upwards and a downwards position, wherein in the upwards position said conic member extends upwards into the upper portion of the container and in the downwards position said conic member extends downwards into said lower support portion; said container being divided by said inner core into a lower section and an upper section, the upper section to receive a fill of an energy-absorbing granular material; said conic member bearing indicia thereon visible from above when said inner core is oriented in its upwards position to indicate a plurality of predetermined levels to which the upper section is to be filled with said granular material; and a cover fitting the top of the upper portion of said container.

8. Inertial barrier according to claim 7, wherein said conic member bears said indicia on its outer conic surface.

9. Inertial barrier according to claim 8, wherein said conic member has additional indicia on an opposite inner surface, the additional indicia being visible from above when the inner core is oriented in its downwards position to indicate a larger fill of said granular material than those indicated by the indicia borne on the outer conic surface.

10. Inertial barrier system for attenuating the kinetic energy of an errant vehicle and to prevent the latter from striking a roadway hazard by presenting a plurality of barriers filled with varying amounts of an energy-absorptive granular material, comprising:

a plurality of similar frangible hollow containers each generally of circular cross section and having an upper portion and a lower support portion, the lower portion being joined to an inner edge of a substantially horizontal annular ledge intermediate said upper and lower portions, whose outer edge is joined to a base of said upper portion, said hollow containers being dimensioned so as to be nestable one inside another to be compactly stacked when stored;

a plurality of similar inner cores of frangible material and each formed substantially as a hollow conic member open at a larger base thereof with an annular flange at the open base thereof and extending outward therefrom, the flange being dimensioned to fit upon and be supported by the ledge of any of said containers, and being orientable into either of an upwards position and a downwards position, wherein in the upwards position said conic member extends upwards into the upper portion of the container and in the downwards position said conic member extends downwards into said lower support portion, said container being divided thereby into a lower section and an upper section, the upper section to receive a fill of an energy-absorbing granular material, said inner cores being dimensioned to be nestable one in another to be compactly stacked when stored; and a plurality of similar covers for fitting the tops of the upper portions of said containers.

11. Inertial barrier according to claim 10, wherein each said conic member is a conic frustrum having a smaller base and a height dimensioned such that when said inner core is oriented in its downward position said smaller base rests on a bottom of the container while the flange thereof rests on the ledge of said container.

12. Inertial barrier according to claim 5, wherein said support section has a height of substantially 18 inches.

13. Inertial barrier according to claim 4, wherein said frustroconic dish has an apical angle $\theta'$ between its axis and conic wall greater than the angle $\theta$ of the lower support section.

* * * * *